US006612563B1

(12) United States Patent
Noll, Jr.

(10) Patent No.: US 6,612,563 B1
(45) Date of Patent: Sep. 2, 2003

(54) STACKING AND COUNTING DEVICE FOR PLANAR PRODUCTS

(75) Inventor: Harry C. Noll, Jr., Allentown, PA (US)

(73) Assignee: Graphic Management Associates, Inc., DE (US)

( * ) Notice: Subject to any disclaimer, the term of this patent is extended or adjusted under 35 U.S.C. 154(b) by 0 days.

(21) Appl. No.: 09/539,531

(22) Filed: Mar. 31, 2000

(51) Int. Cl.[7] ..... B65H 29/68

(52) U.S. Cl. ..... 271/69; 271/82; 271/204; 271/315

(58) Field of Search ..... 271/69, 204, 82, 271/83, 215, 217, 218, 315; 414/789.5, 790.8, 790.9, 794.4, 794.5

(56) References Cited

U.S. PATENT DOCUMENTS

| | | | | | |
|---|---|---|---|---|---|
| 3,827,688 | A | * | 8/1974 | Luffy et al. | 271/204 X |
| 3,907,274 | A | * | 9/1975 | D'Amato et al. | 271/204 X |
| 3,910,424 | A | * | 10/1975 | Kawahara | 271/204 X |
| 4,445,681 | A | * | 5/1984 | Reist | 271/204 X |
| 4,878,888 | A | | 11/1989 | Ullmann | |
| 4,893,805 | A | | 1/1990 | Eberle | |
| 5,090,681 | A | * | 2/1992 | Henn et al. | 414/790.8 X |
| 5,110,108 | A | * | 5/1992 | Muller | 271/204 X |
| 5,409,201 | A | * | 4/1995 | Kramer | 270/58.13 |
| 5,476,256 | A | | 12/1995 | Fortuna et al. | |
| 5,692,740 | A | | 12/1997 | Holtje | |
| 5,772,391 | A | * | 6/1998 | Sjogren et al. | 414/790.9 |
| 6,135,445 | A | * | 10/2000 | Gamperling et al. | 414/790.8 X |

FOREIGN PATENT DOCUMENTS

| | | |
|---|---|---|
| EP | 0644 142 | 3/1995 |
| EP | 0867 394 | 9/1998 |

* cited by examiner

*Primary Examiner*—Patrick Mackey
(74) *Attorney, Agent, or Firm*—Muserlian, Lucas and Mercanti

(57) ABSTRACT

The device stacks successive planar products (newspapers) and separates a plurality of the products into individual stacks. A circular conveyor has a plurality of grippers thereon which are spaced apart by a circumferential distance, grasps the planar products from a linear conveyor, upstream of the circular conveyor, so that the products are transferred from the linear conveyor to the circular conveyor and onto a stack.

22 Claims, 2 Drawing Sheets

STACKING AND COUNTING DEVICE FOR PLANAR PRODUCTS

The present Invention is directed to a device for insuring that a predetermined number of planar products is included in each stack thereof; more specifically, the device accurately counts the products so that stacks of desired size, previously not achieved by the prior art, can be obtained.

BACKGROUND OF THE INVENTION

Devices for handling planar products (usually newspapers) include those wherein the newspapers are stacked and bundled.

In the past, planar products (such as newspapers) have been imbricated on a flat conveyor belt and carried past a counting sensor. However, this is difficult to accomplish with any real degree of precision because of the variations in the relative locations of successive papers. As a result, there is a tendency to intentionally over stack in order to insure that the recipient gets at least the minimum number required. Alternatively, if the correct number is targeted, a real danger exists that some dealers will end up being short.

SUMMARY OF THE INVENTION

The present Invention is directed to a device whereby an accurate count of planar products, as well as an accurate count of the contents of each stack thereof, is readily obtained. Although the present Invention is useful in connection with the handling of planar products in general, especially those which are sufficiently flexible so that they cannot support themselves vertically, the description will be directed to newspapers.

The present Invention is a device for stacking successive newspapers, carried along a feeding path, into pluralities of individual stacks, each of which contains a predetermined number of papers. There is provided a circular conveyor, mounted on a rotatable support, and having a plurality of circular conveyor grippers spaced apart from each other by a circumferential distance. Each of these grippers carries one newspaper and is adapted to release at a stacking point.

There is a sensor, adjacent the feeding path and located at a counting point. The sensor is adapted to count each newspaper as it passes the sensor and while they are spaced apart. The distance between them remains substantially unchanged as the papers move from the counting point to the stacking point. In this manner, the sensor can readily and accurately count the papers since they are individually held and spaced apart from each other. The fact that the papers are counted when they are individually and separately held, and the distance between the papers remains substantially unchanged until the stacking point, insures that the same number counted by the sensor is included in each stack.

In a refinement of the Invention, the circular conveyor grippers release the predetermined number of successive newspapers so that they land on a first receiver. As this occurs, the receiver moves away from the stacking point along a stacking path as the stack is built. Preferably, the speed of movement of the receiver corresponds to the newspapers being placed thereon so that the stacking point remains in the same position relative to the circular conveyor.

It is also within the scope of the present Invention to provide a linear conveyor, having a plurality of spaced apart grippers, each of which carries one of the newspapers along the feeding path. The spaced apart grippers release the papers at a transfer point adjacent the circular conveyor, whereby they are transferred from the spaced apart grippers to the circular conveyor grippers. The distance between the spaced apart grippers and the circular conveyor grippers is preferably the same.

Here, too, the receiver previously defined can be placed adjacent the stacking point. Also, it has been found advantageous to provide a plurality of fingers which individually compress the leading edge of the newspapers as they are placed on the receiver. This results in a particularly compact stack. There can be a plurality of sets (pairs) of fingers which successively compress leading edges of successive newspapers. This enables the fingers to move more slowly, thus saving wear and tear on the device. Alternatively, a second receiver intercepts the stream at the end of the prior stack and starts building a successive stack. The prior stack is thereby compressed between the second receiver and the first receiver.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
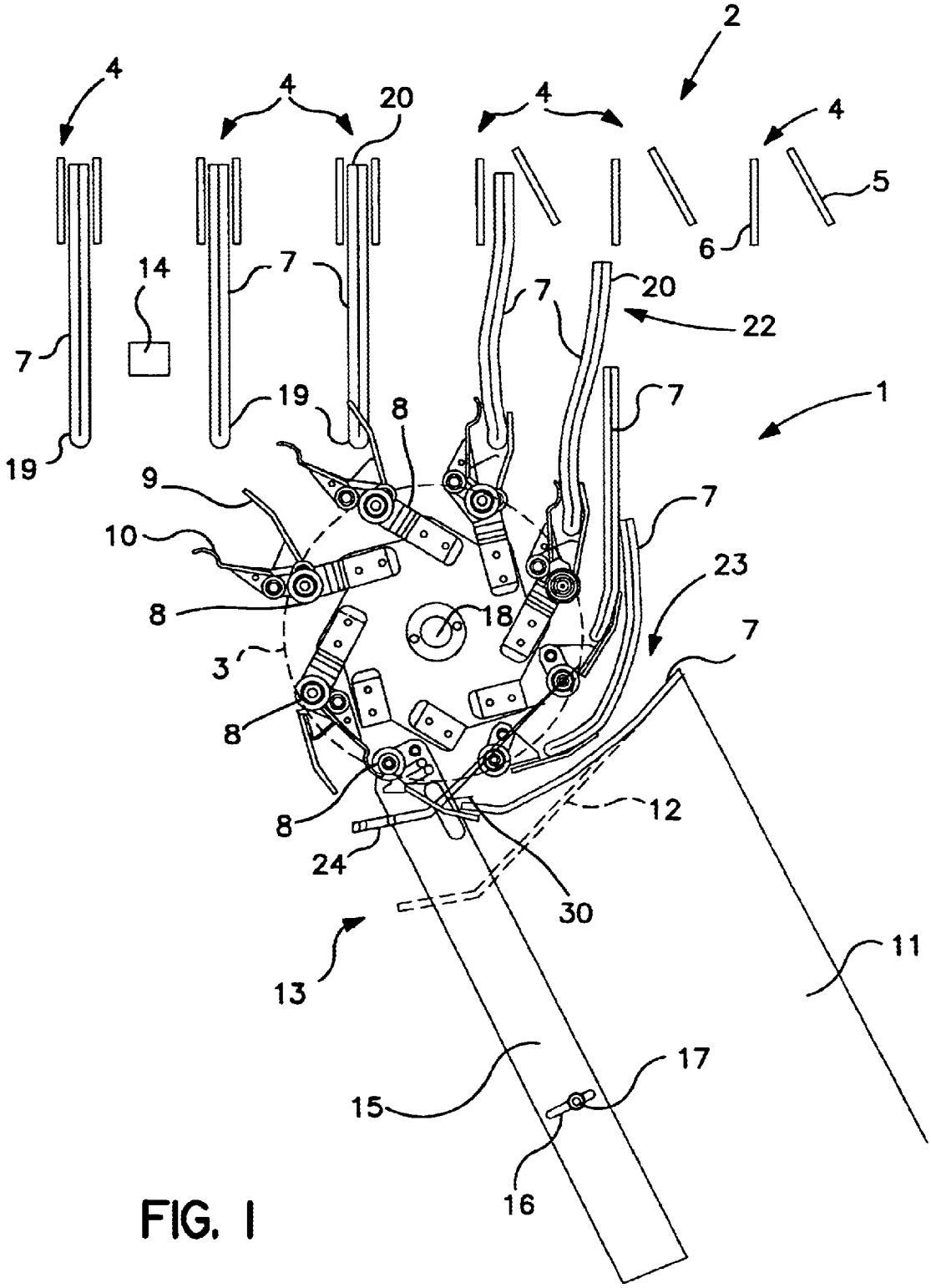
FIG. 1 is a schematic view of the device of the present Invention with some parts omitted for clarity.
Figure 2A:
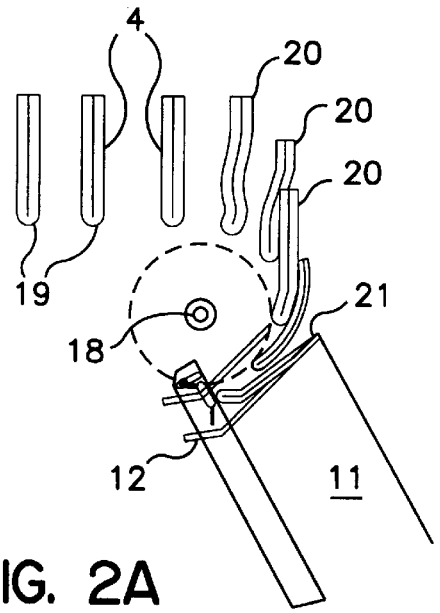
FIG. 2A to FIG. 2E schematically show successive stages in transfer of the newspapers from the linear conveyor to the circular conveyor to the receiver.
Figure 2B:
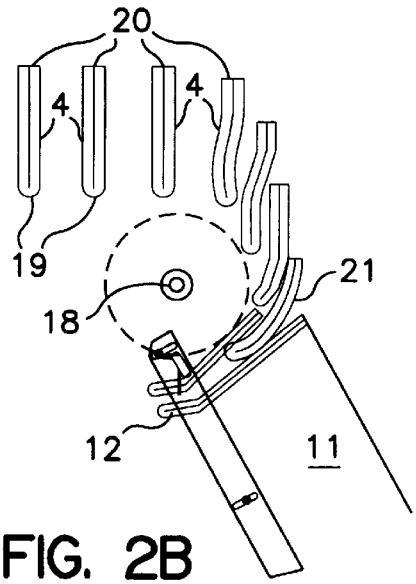
Figure 2C:
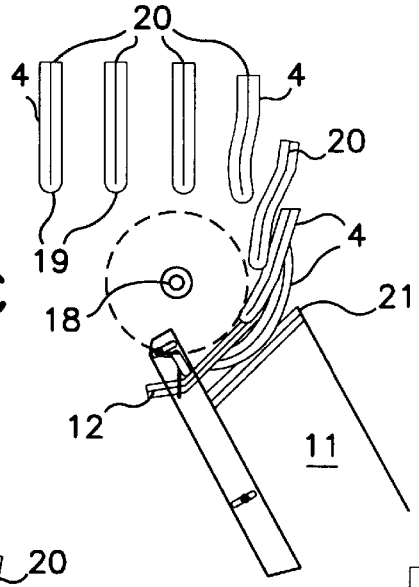
Figure 2D:
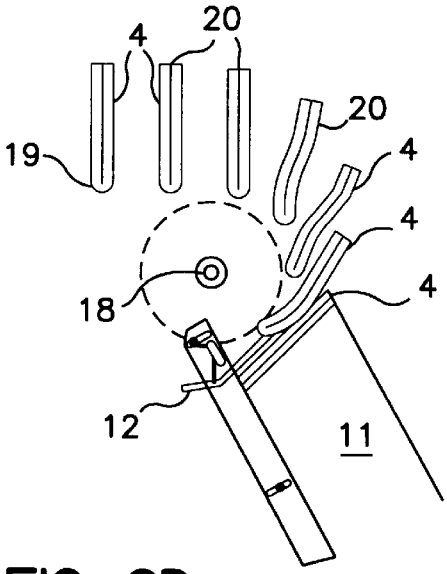
Figure 2E:
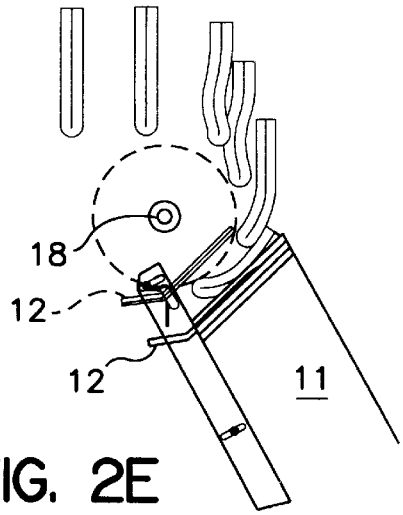

Stacking device 1 comprises linear conveyor 2, circular conveyor 3, and stacking device 13. Linear conveyor 2 carries spaced apart grippers 4, each having movable jaw 5 and fixed jaw 6. The grippers, in a manner known in the art, are hinged so that they individually move between a closed position, wherein the paper is gripped between movable jaw 5 and fixed jaw 6, and an open position where the jaws are out of contact with the newspaper and it is not gripped.

Circular conveyor 3 is provided with circular conveyor grippers 8, each one of which has fixed jaw 9 and movable jaw 10. These operate in substantially the same way as spaced apart grippers 4. However, spaced apart grippers 4 release newspapers 7 at transfer point 22 where circular conveyor grippers 8 close around them. These grippers release at stacking point 23 so that newspapers 7 rest on first fork 12 and against support 15. Should the angle of the support need adjustment, it can be moved by loosening bolt 17 and permitting it to slide in slot 16.

In operation, tails 20 of newspapers 7 are gripped by spaced apart grippers 4 of linear conveyor 2. They are counted as they pass sensor 14. At transfer point 22, spaced apart grippers 4 release and folds 19 of newspaper 7 are gripped by circular conveyor grippers 8. Circular conveyor 3 rotates about axle 18, thereby conveying newspapers 7 to stacking point 23. Here, circular conveyor grippers 8 release so that bottom newspaper 21 falls onto first fork 12 and rests against support 15. Successive newspapers 7 fall onto preceding newspapers until stack 11 is complete. This is determined by sensor 14 as it counts the predetermined number of newspapers which makes up the stack.

Since the distance between successive tails 20 of newspapers 7 (when held in linear conveyor 2) and the distance between successive folds 19 (when the newspapers are held in circular conveyor grippers 8) is the same, the count made by sensor 14 is accurate and exact. When the last newspaper 7 of prior stack 11 passes sensor 14, a signal can be sent out so that when the last newspaper is laid on stack 11, second fork 24 is moved into position to receive the first newspaper of the successive stack. In a preferred form of the Invention, forks 12 and 24 move in a stacking path which is parallel to support 15 at the same speed as that at which successive newspapers 7 are deposited. Therefore, stacking point 23 remains in the same position with respect to circular conveyor 3. Thereafter, stack 11 is bundled and discharged.

It is a particularly preferred form of the Invention that, when prior stack 11 is complete and second fork 24 is placed in receiving position adjacent stacking point 23, it presses toward first fork 12 so that stack 11 is compressed therebetween. This provides a compact stack well suited for bundling.

Finger 30 is shown in FIG. 1 for compressing the leading edge of successive newspapers.

Although only a limited number of particular embodiments of the present Invention have been expressly described, it is, nonetheless, to be broadly construed and not to be limited except by the character of the claims appended hereto.

I claim:

1. A device for stacking successive planar products carried along a feeding path and separating pluralities of said successive planar products into individual stacks, each of said individual stacks containing a predetermined number of said successive planar products, said device comprising a circular conveyor comprising a rotatable support, and a plurality of circular conveyor grippers mounted thereon and spaced apart by a circumferential distance, each of said circular conveyor grippers carrying one of said successive planar products from said feed path to said stacking point and adapted to release said successive planar products at a stacking point;

said circular conveyor grippers grip each of said successive planar products in a plane which substantially bisects the conveyor's axis of rotation;

said circular conveyor positioned between, in a vertical orientation, said feeder path and said stacking point; and a sensor, adjacent said feeding path at a counting point, adapted to count said successive planar products as they pass said sensor and while they are spaced apart by a distance.

2. The device according to claim 1 wherein said distance remains substantially unchanged between said counting point and said stacking point.

3. The device of claim 1 further comprising a first receiver adjacent said stacking point adapted to receive said predetermined number of said successive planar products from said circular conveyor grippers, said first receiver adapted to move away from said stacking point along a stacking path as a prior stack is built from said successive planar products deposited thereon.

4. The device of claim 3 comprising a second receiver adapted to move into said stacking path when said prior stack is complete, whereby said successive planar products are deposited thereon to form a successive stack, said second receiver exerting pressure on said prior stack toward said first receiver, whereby said prior stack is compressed.

5. The device of claim 3 wherein there is at least one finger adapted to individually compress a leading edge of each of said successive planar products as said successive planar products are received by said receiver.

6. The device of claim 3 wherein said stacking point remains substantially stationary with respect to said circular conveyor.

7. The device of claim 5 wherein said finger is adapted to move outside said stacking path while each of said successive planar products is entering said receiver and to move into said stacking path to compress said leading edges when said successive planar products have fully entered said receiver.

8. The device of claim 5 wherein there is a plurality of said fingers compressing each of said successive planar products.

9. The device of claim 5 wherein there is a plurality of sets of said fingers, each of said sets of said fingers compressing one of said successive planar products.

10. The device of claim 6 wherein said finger is substantially level throughout its travel, whereby space required for said travel is reduced.

11. The device of claim 9 wherein each of said sets comprises two pairs of said fingers.

12. The device of claim 1 wherein said sensor is adjacent said stacking point.

13. The device of claim 1 wherein said feeding path comprising a linear conveyor having a plurality of spaced apart grippers carrying said successive planar products along said feeding path, each of said spaced apart grippers holding one of said successive planar products, said spaced apart grippers adapted to release said successive planar products to said circular conveyor grippers.

14. The device of claim 12 further comprising a first receiver adjacent said stacking point adapted to receive said predetermined number of said successive planar products from said circular grippers, said first receiver adapted to move away from said stacking point along a stacking path as a prior stack is built from said successive planar products deposited thereon.

15. The device of claim 14 comprising a second receiver adapted to move into said stacking path when said prior stack is complete, whereby said successive planar products are deposited thereon to form a successive stack, said second receiver exerting pressure on said prior stack toward said first receiver, whereby said prior stack is compressed.

16. The device of claim 13 wherein there is at least one finger adapted to individually compress a leading edge of each of said successive planar products as said successive planar products are received by said receiver.

17. The device of claim 13 wherein said stacking point remains substantially stationary with respect to said circular conveyor.

18. The device of claim 16 wherein said finger is adapted to move outside said path while each of successive planar products is entering said receiver and to move into said stacking path to compress said leading edges when said successive planar products have fully entered said receiver.

19. The device of claim 16 wherein said finger is substantially level throughout its travel, whereby space required for said travel is reduced.

20. The device of claim 16 wherein there is a plurality of said fingers compressing each of said successive planar products.

21. The device of claim 16 wherein there is a plurality of said fingers, each of said fingers compressing said successive planar products.

22. The device of claim 21 wherein there are two pairs of said fingers, each pair compressing said successive planar products.

* * * * *